US006782946B2

(12) United States Patent
Perkins et al.

(10) Patent No.: US 6,782,946 B2
(45) Date of Patent: Aug. 31, 2004

(54) METHOD AND APPARATUS FOR INJECTING ONE OR MORE FLUIDS INTO A BOREHOLE

(75) Inventors: Ernest H. Perkins, Alberta (CA); Douglas A. Lillico, Alberta (CA); Kevin Rispler, Alberta (CA)

(73) Assignee: Alberta Research Council Inc., Edmonton (CA)

( * ) Notice: Subject to any disclaimer, the term of this patent is extended or adjusted under 35 U.S.C. 154(b) by 0 days.

(21) Appl. No.: 10/293,378

(22) Filed: Nov. 12, 2002

(65) Prior Publication Data

US 2003/0066640 A1 Apr. 10, 2003

Related U.S. Application Data

(62) Division of application No. 09/590,250, filed on Jun. 8, 2000, now Pat. No. 6,484,805.

(30) Foreign Application Priority Data

Apr. 18, 2000 (CA) ..... 2306016

(51) Int. Cl.[7] ..... E21B 37/06

(52) U.S. Cl. ..... 166/191; 166/400; 166/306; 166/250.17

(58) Field of Search ..... 166/191, 250.17, 166/268, 400, 263, 305.1, 269, 306

(56) References Cited

U.S. PATENT DOCUMENTS

| | | | |
|---|---|---|---|
| 2,019,418 A | 10/1935 | Lang | |
| 2,107,007 A | 2/1938 | Lang | |
| 2,133,730 A | 10/1938 | Brundred | |
| 2,764,244 A | 9/1956 | Page | |
| 2,869,645 A | 1/1959 | Chamberlain et al. | |
| 2,973,039 A | 2/1961 | Payne, Jr. | |
| 2,991,833 A | 7/1961 | Brown et al. | |
| 3,319,717 A | 5/1967 | Chenoweth | |
| 3,398,796 A | 8/1968 | Fisher, Jr. et al. | |
| 3,454,085 A | 7/1969 | Bostock | |
| 3,527,302 A | 9/1970 | Broussard | |
| 3,945,436 A | 3/1976 | Nebolsine | |
| 4,030,545 A | 6/1977 | Nebolsine | |
| 4,424,859 A | 1/1984 | Sims et al. | |
| 4,569,396 A | 2/1986 | Brisco | |
| 4,842,068 A | 6/1989 | Vercaemer et al. | |
| 5,002,127 A | 3/1991 | Dalrymple et al. | |
| 5,018,578 A | 5/1991 | El Rabaa et al. | |
| 5,350,018 A | 9/1994 | Sorem et al. | |
| 6,182,755 B1 * | 2/2001 | Mansure | 166/180 |

FOREIGN PATENT DOCUMENTS

| | | |
|---|---|---|
| WO | WO 99/34092 | 7/1999 |

* cited by examiner

*Primary Examiner*—David Bagnell
*Assistant Examiner*—Jennifer R. Dougherty
(74) *Attorney, Agent, or Firm*—Terrence N. Kuharchuk; Rodman & Rodman

(57) ABSTRACT

A method and an apparatus for injecting a fluid into a borehole. The method includes the step of injecting an injection fluid into a primary injection zone in a borehole at an injection fluid pressure. The primary injection zone is bounded by a proximal injection zone interface and a distal injection zone interface. The proximal injection zone interface and the distal injection zone interface are maintained at pressures which are substantially balanced with the injection fluid pressure. The apparatus includes a body adapted for passage through a borehole, at least four radially extendable and retractable zone interface elements spaced longitudinally along the body which when extended define at least three zones along the body, a zone interface element actuator for selectively extending and retracting the zone interface elements, and a fluid delivery system for delivering a fluid to each zone. The central zone defined by the zone interface elements is the primary injection zone and the zones on either side of the primary injection zone are balancing zones which are used to achieve substantial pressure balancing with the fluid injection pressure at the proximal injection zone interface and the distal injection zone interface.

15 Claims, 3 Drawing Sheets

METHOD AND APPARATUS FOR INJECTING ONE OR MORE FLUIDS INTO A BOREHOLE

This application is a divisional of the allowed parent application Ser. No. 09/590,250, filed Jun. 8, 2000 now U.S. Pat. No. 6,484,805.

TECHNICAL FIELD

A method and apparatus for injecting one or more fluids into a borehole.

BACKGROUND OF THE INVENTION

Boreholes such as producing wellbores may periodically require treatment in order to maximize the efficiency of the recovery of fluids from the borehole. Such treatments often involve the injection of treatment fluids into the borehole and thus into the formation surrounding the borehole.

The treatment fluids may serve a variety of purposes. For example, fluids may be injected into a borehole in order to "clean" a clogged formation or may be injected into a borehole in order to seal off a portion of the formation which has become fractured or which is excessively permeable. Sometimes the fluid treatment of boreholes requires the injection of several fluids either simultaneously or in sequence.

One option for performing fluid treatment of boreholes is merely to inject treatment fluids into the borehole from the ground on the assumption that an adequate amount of the fluids will be delivered to their desired location. This option is potentially very expensive, since considerable waste of treatment fluids may result. In addition, where a long section of the borehole must be treated, it may be difficult to deliver adequate amounts of treatment fluids to the desired section of the borehole.

A second option for performing fluid treatment of boreholes is to first isolate the section of the borehole that must be treated with packers or other sealing devices and then inject the treatment fluids only into the isolated section. This option is also potentially very expensive, since the apparatus for isolating the treatment section must be installed in the borehole before the fluid treatment occurs and must be removed from the borehole after the fluid treatment is finished. In addition, if multiple sections or a long continuous section of the borehole must be treated, the isolation apparatus must be moved through the borehole between treatments.

Exemplary apparatus and methods for isolating borehole sections for injection of fluids therein include those described in U.S. Pat. No. 2,764,244 (Page), U.S. Pat. No. 2,869,645 (Chamberlain et al), U.S. Pat. No. 3,319,717 (Chenoweth), U.S. Pat. No. 3,398,796 (Fisher et al), U.S. Pat. No. 3,454,085 (Bostock), U.S. Pat. No. 3,527,302 (Broussard), U.S. Pat. No. 3,945,436 (Nebolsine), U.S. Pat. No. 4,030,545 (Nebolsine), U.S. Pat. No. 4,424,859 (Sims), U.S. Pat. No. 5,002,127 (Dalrymple et al), U.S. Pat. No. 5,018,578 (El Rabaa et al) and U.S. Pat. No. 5,350,018 (Sorem et al).

The apparatus described in the above patents constitute relatively fixed and permanent installations in the borehole which typically require the setting of the sealing devices before fluid injection takes place and the unsetting of the sealing devices after fluid injection is finished in order to facilitate the injection apparatus being removed from or moved within the borehole.

It would be desirable to be able to move the injection apparatus through the borehole without first setting and unsetting the sealing devices since this would undoubtedly result in a saving of time and cost associated with fluid treatment. Unfortunately, none of the patents referred to above appear to contemplate simultaneous fluid injection and movement of the injection apparatus through the borehole.

One explanation for this is that it is difficult to achieve the objective of isolating the section of the borehole into which injection is performed without the use of sealing devices which exert a relatively high sealing force against the interior surface of the borehole, which sealing force is an impediment to movement of the injection apparatus through the borehole.

One attempt to provide an injection apparatus which offers simultaneous fluid injection and movement of the apparatus through the borehole is found in PCT International Publication No. WO 99/34092 (Blok et al), which was published on Jul. 8, 1999.

The Blok apparatus includes a tool which comprises at least three axially spaced swab assemblies which define at least two annular spaces between the tool body and a wellbore. In use the tool is moved through the wellbore while a first treatment fluid is pumped via a first annular space into the wellbore and the formation and a second treatment fluid is pumped via a second annular space into the wellbore and the formation.

The combined effect in Blok of the movement of the tool and the injection of the two treatment fluids is that the first treatment fluid enters the formation before the second treatment fluid so that the two treatment fluids together provide a complete fluid treatment without the need for wellbore cycling to deliver different fluids to the treatment zone separately.

The swab assemblies in Blok are required to satisfy two somewhat incompatible design criteria since they must minimize the amount of sealing force between themselves and the wellbore in order to facilitate movement of the tool through the wellbore and also must provide an "effective seal" between the annular spaces in order to maintain segregation of the treatment fluids in the wellbore before they enter the formation.

In some circumstances, it may be desirable to maintain segregation of fluids after they have entered the formation in addition to maintaining their segregation within the borehole. Blok does not appear to contemplate or address this issue.

One mechanism for maintaining segregation of different fluids in the formation surrounding the borehole is to create an interface between them which restricts their movement in the borehole.

U.S. Pat. No. 4,842,068 (Vercaemer et al) contemplates containing a fluid treatment zone between two protection zones in a wellbore and a formation by simultaneously injecting a treatment fluid into the treatment zone and injecting protection fluids into the protection zones. The interface between the treatment fluid and the protection fluids is created by providing that the protection fluids are immiscible with the treatment fluid. There is no discussion in Vercaemer concerning the pressures or relative pressures at which the treatment fluid and the protection fluids are injected into the wellbore and the formation. There is also no indication in Vercaemer that the method can be performed while moving the injection apparatus through the wellbore.

U.S. Pat. No. 5,002,127 (Dalrymple et al) describes a method for controlling the permeability of an underground well formation by creating a chemical barrier in the formation as an interface between fluids. This chemical barrier is created by simultaneously injecting a first treatment fluid and a second sealant fluid into the formation via a wellbore which is fitted with a packer for maintaining separation of the first fluid and the second fluid in the wellbore. Migration of the second fluid into the portion of the formation occupied by the first fluid is inhibited by substantially balancing the injection pressures of the first fluid and the second fluid. Dalrymple does not contemplate moving the injection apparatus (including the packer) through the wellbore while injection of the first fluid and the second fluid is ongoing.

U.S. Pat. No. 5,018,578 (El Rabaa et al) contemplates the delivery of two separate fluids into two separate zones in a borehole, which zones are separated within the borehole by sealing means such as a packer. The two fluids are chemically reactive with each other such that they form a precipitate which acts as a barrier and interface between the two zones in the formation surrounding the borehole.

Although El Rabaa indicates that the two fluids should be injected into the borehole and the formation sufficient to achieve the stated goal of fracturing the formation in a controlled manner, there is no discussion in El Rabaa concerning the relative pressures at which the two fluids should be injected in order to control the location of the chemical barrier between the two injection zones. Furthermore, El Rabaa does not suggest that the injection apparatus (including the sealing means) can be moved through the wellbore while the two fluids are injected into the wellbore.

It would be advantageous to apply the principles for creating an interface between two fluids to the design of an apparatus which can be moved through a borehole while fluid injection is taking place in order to provide an apparatus which facilitates segregation of different fluids within the borehole while minimizing the design requirements for seals which are included in the apparatus.

SUMMARY OF THE INVENTION

The present invention is a method and apparatus for injecting one or more fluids into a borehole in a plurality of zones by creating interfaces in the borehole between zones. The interfaces may be constituted by sealing devices, chemical barriers, physical barriers, pressure balancing between fluids, or by a combination of techniques. Preferably the interfaces are constituted by using a combination of zone interface elements and pressure balancing techniques.

In a method aspect, the invention is a method for injecting an injection fluid into a borehole, the method comprising the following simultaneous steps:

(a) injecting the injection fluid into a primary injection zone in the borehole at an injection fluid pressure, wherein the primary injection zone is bounded longitudinally by a proximal injection zone interface and a distal injection zone interface;

(b) maintaining pressure at the proximal injection zone interface at a proximal interface pressure which is substantially balanced with the injection fluid pressure; and (c) maintaining pressure at the distal injection zone interface at a distal interface pressure which is substantially balanced with the injection fluid pressure.

The pressure maintaining steps may be performed in any manner which substantially balances the pressures at the injection zone interfaces. Preferably the step of maintaining pressure at the proximal injection zone interface may be comprised of injecting a proximal balancing fluid into a proximal balancing zone in the borehole, wherein the proximal balancing zone is adjacent to the proximal injection zone interface. Preferably the step of maintaining pressure at the distal injection zone interface may be comprised of injecting a distal balancing fluid into a distal balancing zone in the borehole, wherein the distal balancing zone is adjacent to the distal injection zone interface.

The balancing zones may be comprised of a single balancing zone stage or a plurality of balancing zone stages.

Preferably the proximal balancing zone is comprised of a plurality of proximal balancing zone stages disposed sequentially between a proximal end of the proximal balancing zone and the proximal balancing zone interface and the step of maintaining pressure at the proximal injection zone interface is comprised of simultaneously injecting the proximal balancing fluid into each of the proximal balancing zone stages such that a positive pressure gradient is formed from the proximal end of the proximal balancing zone to the proximal injection zone interface.

Preferably the distal balancing zone is comprised of a plurality of distal balancing zone stages disposed sequentially between a distal end of the distal balancing zone and the distal balancing zone interface and the step of maintaining pressure at the distal injection zone interface is comprised of simultaneously injecting the distal balancing fluid into each of the distal balancing zone stages such that a positive pressure gradient is formed from the distal end of the distal balancing zone to the distal injection zone interface.

In the preferred embodiment, each pair of adjacent balancing zone stages is separated by a proximal balancing zone interface. In the preferred embodiment, the proximal balancing fluid has a pressure in each proximal balancing zone stage and the pressure increases between adjacent proximal balancing stages from the proximal end of the proximal balancing zone to the proximal balancing zone interface. In the preferred embodiment, the distal balancing fluid has a pressure in each distal balancing zone stage and the pressure increases between adjacent distal balancing stages from the distal end of the distal balancing zone to the distal balancing zone interface.

Preferably, the method further comprises the step of moving the primary injection zone longitudinally through the borehole while injecting the injection fluid into the primary injection zone and further comprises the step of sensing at least one borehole parameter in the primary injection zone while moving the primary injection zone longitudinally through the borehole.

The step of moving the primary injection zone longitudinally through the borehole may be performed using any apparatus or method. The sensed borehole parameter or parameters may be comprised of any characteristic or property of the borehole or the formation surrounding the borehole, including but not limited to temperature, pressure, permeability, porosity, composition etc. Data pertaining to the sensing of the borehole parameter or parameters may be recorded for analysis at a later date and may be stored with the apparatus performing the method or transmitted for storage outside the borehole.

The proximal balancing fluid and the distal balancing fluid may be comprised of the same fluid or different fluids and the balancing fluids may be different in different balancing zone stages, so long as the pressure maintaining steps can be facilitated. The balancing fluids may be comprised of treatment fluids or may be fluids which serve no purpose other than facilitation of the pressure balancing steps.

In an apparatus aspect, the invention is an apparatus for injecting an injection fluid into a borehole, the apparatus comprising:

(a) a body adapted for passage through the borehole such that an annular space is provided between an outer surface of the body and an inner surface of the borehole;

(b) at least four radially extendable and retractable zone interface elements spaced longitudinally along the body, for filling the annular space between the outer surface of the body and the inner surface of the borehole when extended to define at least three zones along the body;

(c) a zone interface element actuator associated with the zone interface elements for selectively extending and retracting the zone interface elements; and (d) a fluid delivery system associated with each zone for delivering a fluid to each zone;

wherein the zone interface elements when extended permit the passage of the body through the borehole while inhibiting the fluids from passing between zones.

The fluid delivery system may be comprised of any method or apparatus for delivering fluids to the zones, including but not limited to conduits which are connected with a remote source of fluid or pressurized tanks of fluid associated with the apparatus. Preferably the fluid delivery system is comprised of a plurality of fluid delivery conduits wherein each zone is provided with fluid from at least one fluid delivery conduit. In the preferred embodiment the fluid delivery conduits are carried within the body of the apparatus.

The zone interface element actuator may be comprised of any apparatus or plurality of apparatus which is capable of extending and retracting the zone interface elements. Preferably the zone interface element actuator is comprised of a reciprocating actuator piston which is contained within an actuator chamber. In the preferred embodiment the actuator chamber is carried on the body of the apparatus.

In the preferred embodiment the zone interface element actuator is further comprised of a linkage assembly for operatively linking the actuator piston with the zone interface elements such that reciprocation of the actuator piston will alternately extend and retract the zone interface elements. Preferably the linkage assembly is comprised of a plurality of linkage collars positioned between adjacent zone interface elements for connecting adjacent zone interface elements. Preferably the zone interface elements and the linkage collars are slidably carried on the outer surface of the body of the apparatus. Preferably the fluid delivery conduits communicate with the zones via apertures defined by the linkage collars.

The zone interface elements may be comprised of any apparatus including any structure or device which is capable of extending and retracting and which when extended will provide a zone interface without unduly inhibiting movement of the apparatus through the borehole. The zone interface elements therefore preferably exert only a minimal sealing force against the inner surface of the borehole when they are extended which is sufficient to maintain substantial segregation of fluids between zones when the pressures between zones are substantially balanced.

As a result, the zone interface elements are not comprised of conventional packers or other sealing devices which are designed to maintain a seal between zones where a significant pressure differential exists between zones by exerting a relatively high sealing force against the inner surface of the borehole. Instead, the zone interface elements may be described as "relatively low pressure sealing devices" since they need only provide substantial segregation of fluids in situations where there is a relatively low pressure differential across them.

Preferably the zone interface elements also are not comprised of sealing devices which rely upon significant pressure differentials between zones to provide or enhance their sealing force and thus their sealing capacity. For example, cup type packers or swab assemblies may possibly not be preferred for use as zone interface elements unless they are capable of maintaining substantial segregation of fluids between zones when the pressures between zones are substantially balanced while still permitting relatively uninhibited movement of the apparatus through the borehole when they are extended.

There are therefore two essential criteria for selection of the zone interface elements. First, the total sealing force exerted against the inner surface of the borehole by all of the zone interface elements when they are extended should not unduly inhibit the movement of the apparatus through the borehole. Second, the sealing capacity of each of the zone interface elements should be such that when they are extended they are capable of maintaining substantial segregation of fluids between the injection zone and the balancing zones under the operating conditions of the apparatus. The required sealing capacity of the zone interface elements is controlled by controlling the differential pressure across each of the zone interface elements during use of the apparatus.

In the preferred embodiment, the zone interface elements are comprised of bellows-shaped resilient members which are extended when they are compressed and which are retracted when they are expanded. Preferably the bellows-shaped resilient members provide an outer surface which is gently contoured or rounded when the members are extended in order to facilitate relatively uninhibited movement of the apparatus through the borehole.

The actuator piston is preferably actuated by movement within the actuator chamber under the influence of an actuator fluid. The actuator fluid may be comprised of any gas or liquid and may be the same fluid as any of the injection fluid or the balancing fluids.

Preferably the zone interface element actuator is therefore further comprised of at least one actuator conduit for delivering an actuating fluid to the actuating chamber. Preferably the actuator piston divides the actuator chamber into two sides and preferably the actuator piston is a double acting piston such that the zone interface elememt actuator is comprised of a plurality of actuator conduits for delivering actuator fluid to both sides of the actuator chamber. In the preferred embodiment the actuator conduits are carried within the body of the apparatus.

The fluids and the actuator fluid may be delivered to the zones and the actuator chamber via the fluid delivery conduits and the actuator conduits in any manner. The source of the fluids and the actuator fluid may be located outside of the borehole or inside of the borehole. The source of the fluids and the actuator fluid may also be carried on, in or with the apparatus.

Preferably the source of the fluids is located outside of the borehole and the fluids and the actuator fluid are delivered to the apparatus via the fluid delivery conduits and the actuator conduits via one or more injector devices. Preferably the injector device or devices are located outside of the borehole and are operated from outside of the borehole.

The apparatus is preferably adapted to be moved through the borehole while fluids are being injected into the zones.

The apparatus may be moved through the borehole in any manner. In the preferred embodiment the apparatus is connected to a conduit such as a jointed pipe string or coiled tubing string for movement through the borehole. The apparatus may, however, also be configured for connection with a wireline or other suitable conveying system or mechanism. As a result, preferably the apparatus is further comprised of a connector for connecting the apparatus to an apparatus conveying mechanism which is preferably operated from outside of the borehole.

BRIEF DESCRIPTION OF DRAWINGS

Embodiments of the invention will now be described with reference to the accompanying drawings, in which.

DETAILED DESCRIPTION

Figure 1:
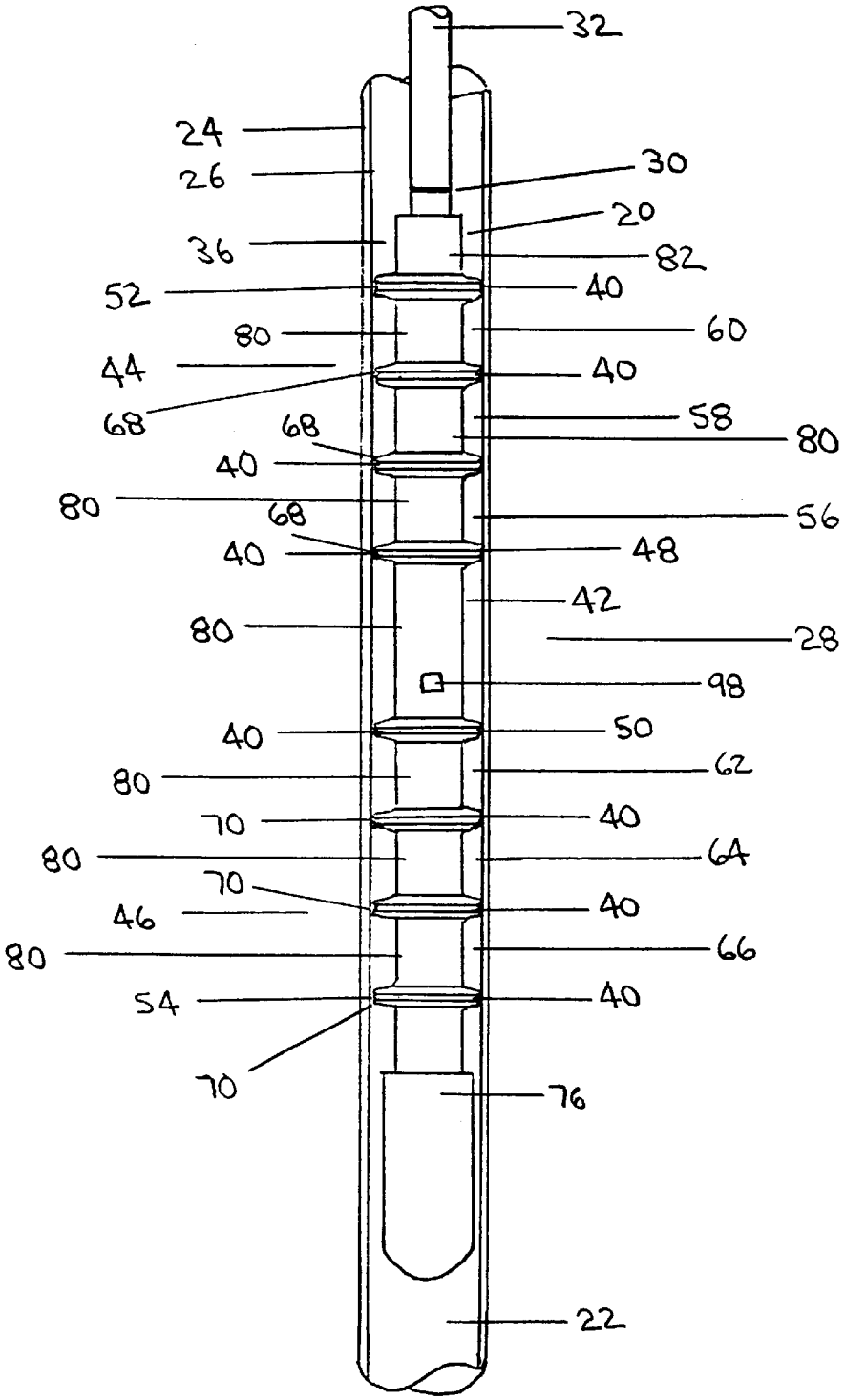
FIG. 1 is a pictorial drawing of a preferred embodiment of the apparatus of the invention in place in a borehole with the zone interface elements extended.

Referring to FIG. 1, there is depicted a preferred embodiment of the apparatus (20) of the invention in place within a borehole (22). The borehole (22) is preferably lined with a casing (24) or some other form of liner in order that an inner surface (26) of the borehole (22) is a relatively smooth surface. It may, however, be possible to practice the invention in an unlined borehole (22) if the unlined inner surface (26) of the borehole (22) is relatively smooth and consistent.

The borehole (22) is surrounded by a formation (28). The casing (24) or other liner is perforated in some manner in order that the borehole (22) may communicate with the formation (28). Perforations may not be necessary if the borehole (22) is unlined.

In the preferred embodiment the apparatus (20) includes a connector (30) for connecting the apparatus (20) with an apparatus conveying mechanism operated from outside of the borehole (22). In the preferred embodiment the apparatus conveying mechanism includes a coiled tubing string (32) and the connector (30) connects the apparatus (20) to the coiled tubing string (32). Alternatively the apparatus conveying mechanism may include a jointed pipe string, a wireline or some other structure which facilitates the conveying of the apparatus (20) through the borehole (22) from outside of the borehole (22). The apparatus (20) may also be self-propelled.

Figure 2:
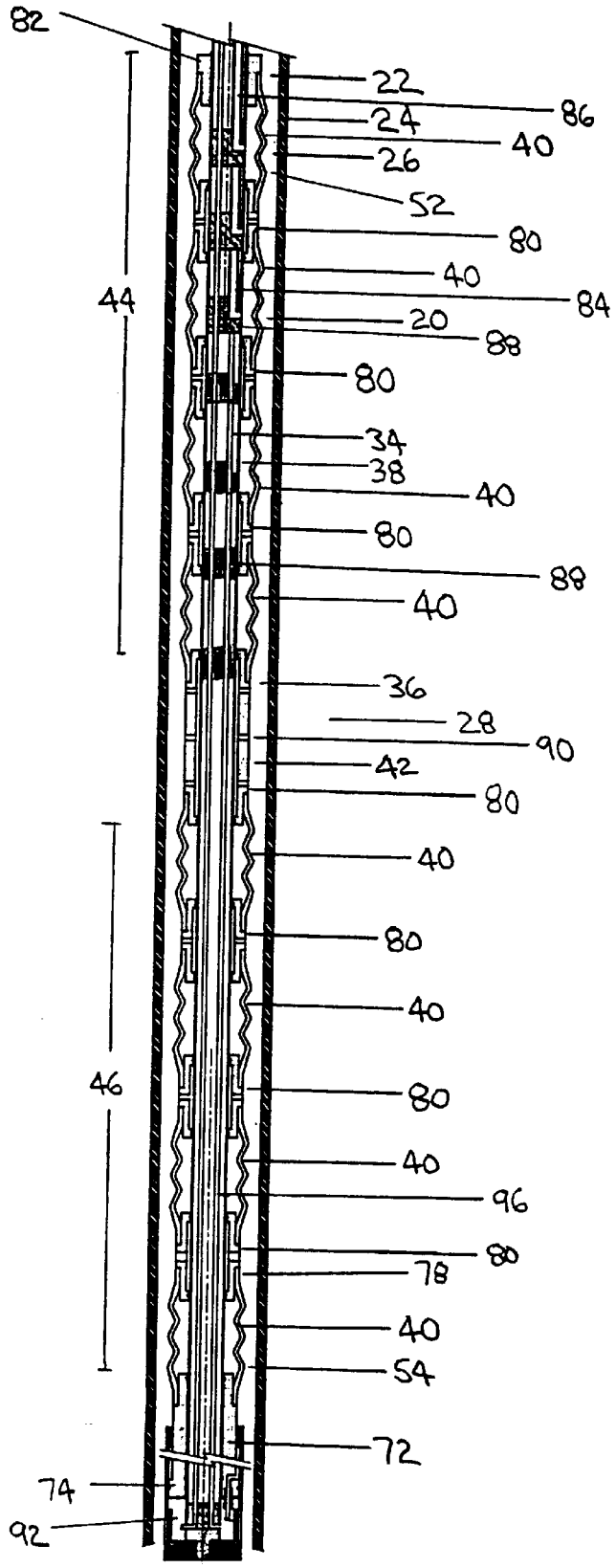
FIG. 2 is a longitudinal sectional drawing of a portion of the apparatus of FIG. 1 in place inside a borehole with the zone interface elements retracted.
Figure 3:
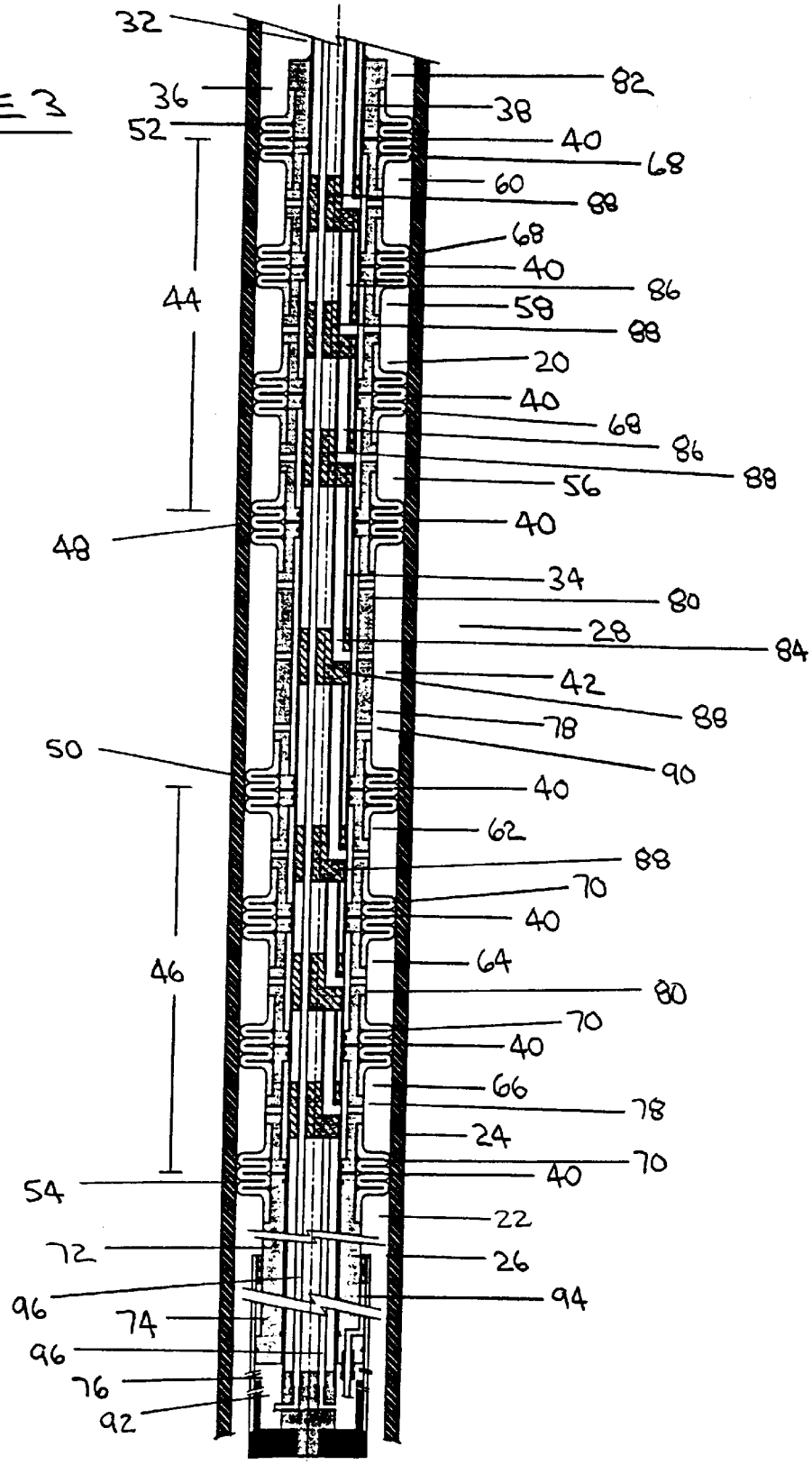
FIG. 3 is a longitudinal sectional drawing of a portion of the apparatus of FIG. 1 in place inside a borehole with the zone interface elements extended.

Referring to FIGS. 1, 2 and 3, the apparatus (20) includes a body (34) which in the preferred embodiment is essentially an extension of the coiled tubing string (32). In the preferred embodiment the body (34) is threadably connected to the coiled tubing string (32). Alternatively, the body (34) may be formed integrally as a continuation of the coiled tubing string (32) or may be connected to the coiled tubing string (32) by welding or by using some other suitable connector.

The body (34) is sized such that an annular space (36) is provided between an outer surface (38) of the body (34) and the inner surface (26) of the borehole (22).

The apparatus (20) further comprises at least four radially extendable and retractable zone interface elements (40) which are spaced longitudinally along the body (34). When the zone interface elements (40) are extended they fill the annular space (36) to define at least three zones along the body (34), which zones are thereby separated by zone interfaces comprised of the zone interface elements (40).

Retraction of the zone interface elements (40) facilitates movement of the apparatus (20) through the borehole (22) without causing damage to or undue wear on the zone interface elements (40). Extension of the zone interface elements (40) enable them to perform their interface function during use of the apparatus (20).

The central zone is a primary injection zone (42) and is located between a proximal balancing zone (44) and a distal balancing zone (46). The primary injection zone (42) is bounded longitudinally by a proximal injection zone interface (48) and a distal injection zone interface (50). The proximal balancing zone (44) extends between a proximal end (52) of the proximal balancing zone (44) and the proximal injection zone interface (48). The distal balancing zone (46) extends between a distal end (54) of the distal balancing zone (46) and the distal injection zone interface (50).

In the preferred embodiment the apparatus includes eight zone interface elements (40), resulting in eight zone interfaces which define and separate seven zones along the body (34). The proximal balancing zone (44) is therefore segregated into three proximal balancing zone stages (56,58,60) and the distal balancing zone (46) is segregated into three distal balancing zone stages (62,64,66). The proximal balancing zone stages (56,58,60) are disposed sequentially between the proximal end (52) of the proximal balancing zone (44) and the proximal injection zone interface (48) and the distal balancing zone stages (62,64,66) are disposed sequentially between the distal end (54) of the distal balancing zone (46) and the distal injection zone interface (50).

Each of the proximal balancing zone stages (56,58,60) are separated by one of the zone interface elements (40) as a proximal balancing zone stage interface (68). In the preferred embodiment, the proximal end (52) of the proximal balancing zone (44) is also defined by one of the zone interface elements (40). Each of the distal balancing zone stages (62,64,66) are separated by one of the zone interface elements (40) as a distal balancing zone stage interface (70). In the preferred embodiment, the distal end (54) of the distal balancing zone (46) is also defined by one of the zone interface elements (40).

Conventional sealing devices typically rely upon sealing force to avoid failure of the sealing device resulting from differential pressure across the sealing device. As a result, the higher the differential pressure across a sealing device the higher the required sealing force which must be exerted against the inner surface (26) of the borehole (22) in order to avoid failure. The higher the sealing force which must be exerted against the inner surface (26) of the borehole (22) to avoid failure of the sealing device the more resistance to movement that will be provided by the sealing device.

In the practice of the invention the sealing force exerted by the zone interface elements (40) against the inner surface (26) of the borehole (22) should therefore be minimized.

It is one of the features of the invention that the balancing zones (44,46) operate to reduce the differential pressure across the zone interface elements (40). By carefully controlling the differential pressures across the zone interfaces during use of the apparatus (20) and performance of the method of the invention, the necessary sealing force to be exerted against the inner surface (26) of the borehole (22) and the sealing requirements of the zone interface elements (40) can be minimized. By increasing the number of zone stages (56,58,60,62,64,66) between the injection zone interfaces (48,50) and the ends of the balancing zones (52,54) the required sealing capacity of each zone interface element (40) can be reduced.

The zone interface elements (40) may thus be comprised of any structure or apparatus which is extendable and retractable and which when extended will fill the annular space (36) to provide the necessary interfaces (48,50,68,70) while still permitting movement of the apparatus (20) through the borehole (20) without undue restriction during use of the apparatus (20). As indicated above, this result is made possible during use of the apparatus (20) by controlling the differential pressure across the zone interface elements (40) so that the zone interface elements (40) are required to function only as relatively low pressure seals and are thus required only to exert a minimal sealing force against the inner surface (26) of the borehole (22).

Many seal designs may therefore be suitable for use in the invention as zone interface elements (40). In the preferred embodiment, however, the zone interface elements (40) are comprised of bellows-shaped resilient members which are extended when compressed and which are retracted when expanded.

By "bellows-shaped resilient member" it is meant that the zone interface elements will respond to axial compression and expansion with a corresponding increase or decrease in radial dimension. These bellows-shaped resilient members preferably have outer surfaces which are rounded or gently contoured when the zone interface elements (40) are extended in order to facilitate further the relatively uninhibited movement of the apparatus (20) through the borehole (22).

The apparatus (20) is further comprised of a zone interface element actuator (72) associated with the zone interface elements (40) for selectively extending and retracting the zone interface elements (40).

In the preferred embodiment the zone interface element actuator (72) actuates the zone interface elements (40) by axially compressing or expanding them in order to extend or retract them.

In the preferred embodiment the zone interface element actuator (72) is comprised of a reciprocating actuator piston (74) which is contained within an actuator chamber (76). The actuator chamber (76) in turn is preferably carried upon the body (34) of the apparatus (20) but could alternatively be contained within the body (34) or be otherwise associated with the apparatus (20).

The actuator piston (74) is hydraulically or pneumatically powered and may be single acting or double acting. If the actuator piston (74) is a single acting piston then the zone interface element actuator (72) preferably includes a biasing device such as a spring for urging the actuator piston (74) toward a "home" position. In the preferred embodiment the actuator piston (74) is a double acting piston and is hydraulically powered.

The actuator piston (74) may be associated with the zone interface elements (40) in any manner which permits actuation of the zone interface elements (40) in response to reciprocation of the actuator piston (74). In the preferred embodiment the zone interface element actuator (72) is further comprised of a linkage assembly (78) which links the actuator piston (74) and the zone interface elements (40).

In the preferred embodiment the linkage assembly (78) is comprised of a plurality of linkage collars (80) between adjacent zone interface elements (40) for connecting adjacent zone interface elements (40). The zone interface elements (40) and the linkage collars (80) are both slidably carried on the outer surface (38) of the body (34).

The zone interface element actuator (72) is preferably also comprised of a stop collar (82) which is located at the proximal end (52) of the proximal balancing zone (44). The stop collar (82) is fixedly mounted on the body (34) of the apparatus (20) so that the actuator piston (74) moves toward and away from the stop collar (82) to effect compression and expansion of the zone interface elements (40). Other structures for providing a stop or limiting function for the zone interface element actuator (72) may be used, such as for example stop lugs on the outer surface (38) of the body (34).

The apparatus (20) is further comprised of a fluid delivery system (84) associated with each zone (42,44,46) and zone stage (56,58,60,62,64,66) for delivering from a fluid source or sources a fluid to each zone (42,44,46) and zone stage (56,58,60,62,64,66).

In the preferred embodiment the fluid delivery system (84) is comprised of a plurality of fluid delivery conduits (86) with at least one fluid delivery conduit (86) communicating with each zone (42,44,46) and zone stage (56,58,60, 62,64,66). The fluid delivery conduits (86) are preferably carried within the body (34) of the apparatus (20).

Preferably each zone (42,44,46) and zone stage (56,58, 60,62,64,66) communicates with a separate fluid delivery conduit (86) in order to maximize control and flexibility over the delivery of fluids with respect to the pressure and composition of fluids which are delivered. The apparatus (20) may, however, be configured so that a particular fluid delivery conduit (84) delivers fluid to more than one zone (42,44,46) or zone stage (56,58,60,62,64,66).

In the preferred embodiment the fluid delivery system (84) is further comprised of a plurality of manifolds (88) which are mounted within the body (34) of the apparatus (20). Referring to FIGS. 2 and 3, the fluid delivery conduits (86) are routed and maintained in proper position and orientation by the manifolds (88), which manifolds (88) are aligned longitudinally with the linkage collars (80) when the zone interface elements (40) are in the extended position.

In the preferred embodiment the zone interface element actuator (72) and the fluid delivery system (84) therefore cooperate to deliver fluids to each of the zones (42,44,46) and zone stages (56,58,60,62,64,66).

Reciprocation of the actuator piston (74) causes the linkage collars (80) to move longitudinally along the body (34) as the zone interface elements (40) extend or retract. When the zone interface elements (40) are in their extended position and the apparatus (20) is thus ready for use, the manifolds (88) are aligned with the linkage collars (80). Each of the linkage collars (80) defines at least one aperture (90) which then communicates with at least one of the fluid delivery conduits (86) through the adjacent manifold (88) to deliver fluid to the zone (42,44,46) or zone stage (56,58,60, 62,64,66).

Fluids are delivered via the fluid delivery system (84) using one or more fluid sources (not shown). The number of required fluid sources will depend upon the number of different fluids which are to be delivered and the pressures of those fluids. The fluid sources may be incorporated into and carried on or with the apparatus (20).

In the preferred embodiment, the fluid sources are not part of the fluid delivery system (84) but instead are located outside of the borehole during use of the apparatus (20) and are connected with the fluid delivery system (84) by fluid source conduits (not shown) which connect with the fluid delivery conduits (86). Preferably the fluid source conduits are carried within the coiled tubing string (32) which is used to convey the apparatus (20) through the borehole (22).

As previously indicated, in the preferred embodiment the actuator piston (74) is a double acting piston. As a result, in the preferred embodiment the actuator piston (74) divides the actuator chamber (76) into two sides. One side of the actuator chamber (76) is an extension chamber (92) into which an actuating fluid may be delivered in order to effect extension of the zone interface elements (40). The other side of the actuator chamber (76) is a retraction chamber (94) into which an actuating fluid may be delivered in order to effect retraction of the zone interface elements (40).

The zone interface element actuator (72) is therefore further comprised in the preferred embodiment of a plurality of actuator conduits (96) for delivering the actuating fluid to both sides of the actuator chamber (76). If the actuator piston (74) is a single acting piston then only one actuator conduit (96) may be required, in which case the zone interface element actuator (72) is preferably further comprised of a biasing device (not shown) for urging the actuator piston (74) into a "rest position". The actuator conduits (96) are preferably carried within the body (34) of the apparatus (20) and are routed and maintained in position and orientation by the manifolds (88).

The actuator conduits (96) are connected with at least one actuator fluid source (not shown). As with the fluid source, the actuator fluid source may be incorporated into or carried on the apparatus (20). In the preferred embodiment the actuator fluid source is located outside of the borehole (22) during use of the apparatus (20) and is connected with the actuator conduits (96) via actuator source conduits (not shown) which are preferably contained within the coiled tubing string (32) which is used to convey the apparatus (20) through the borehole (22).

In the preferred embodiment the actuator chamber (76) is located adjacent to the distal end (54) of the distal balancing zone (46) so that the zone interface element actuator (72) moves the zone interface elements (40) toward the stop collar (82) at the proximal end (52) of the proximal balancing zone (44). The apparatus (20) may be configured to operate in reverse by interchanging the locations of the actuator chamber (76) and the stop collar (82).

The apparatus (20) may be further comprised of a sensing apparatus (98) for sensing one or more borehole parameters in the primary injection zone (42). Such borehole parameters may relate to temperature, pressure, porosity, permeability or some other environmental aspect of the borehole (22). The sensing apparatus (98) may include a storage and memory device or may transmit sensed data to a location remote of the apparatus (20) via hard-wired connection, telemetry or some other system.

The method of the invention may be performed using the apparatus (20) of the invention as described herein and may also be performed using other apparatus, such as for example the apparatus described in PCT International Publication No. WO 99/34092 (Blok).

With reference to the apparatus (20) of the invention, the method of the invention is comprised of the step of injecting an injection fluid into the primary injection zone (42) at an injection fluid pressure while maintaining a proximal interface pressure at the proximal injection zone interface (48) and a distal interface pressure at the distal injection zone interface (50) which are both substantially balanced with the injection fluid pressure.

By "substantially balanced" it is meant that the differential pressure across the proximal injection zone interface (48) and the distal injection zone interface (50) is such that the zone interface elements (40) can be designed as relatively low pressure seals and yet maintain substantial segregation of fluids between zones during practice of the method. By "relatively low pressure seals" it is meant that the required sealing force which must be exerted by the zone interface elements (40) against the inner surface (26) of the borehole (22) is such that the total force exerted by the zone interface elements (40) when they are extended will not unduly inhibit movement of the apparatus (20) through the borehole (22).

As a result, the design of the zone interface elements (40) requires consideration of the maximum total sealing force exerted by the zone interface elements (40) when they are extended that can be tolerated in moving the apparatus (20) through the borehole (22) as well as the expected total pressure differential between the injection fluid pressure and the ambient pressure in the borehole (22). The total sealing force exerted by the zone interface elements (40) when they are extended is a function of the number of zone interface elements (40), while the number of required zone interface elements (40) is a function of the total pressure differential that must be "staged" between the injection zone interfaces (48,50) and the ends (52,54) of the balancing zones (44,46).

Preferably the proximal interface pressure and the distal interface pressure are maintained slightly higher than the injection fluid pressure during practice of the method in order to more effectively contain the injection fluid within the primary injection zone (42).

The maintenance of the proximal interface pressure and the distal interface pressure may be accomplished in many different ways. In the preferred embodiment of the method (using the apparatus (20) of the invention) the maintenance of pressures is achieved by injecting a proximal balancing fluid into the proximal balancing zone (44) and injecting a distal balancing fluid into the distal balancing zone (46).

The injection fluid may be any fluid which is sought to be delivered to the borehole (22) and the formation (28) surrounding the borehole (22). The injection fluid may therefore be a treatment fluid for performing various treatments on the borehole (22) and formation (28) or may be water, cement or some other type of fluid.

The proximal balancing fluid and the distal balancing fluid may be the same fluid or they may be different fluids. They may also be the same fluid as the injection fluid.

Depending upon the requirements of the borehole (22) and the purpose of the injection of fluids being conducted in the primary injection zone (42), the injection fluid pressure may be significantly higher than the ambient pressure in the borehole adjacent to the balancing zones (44,46). In such circumstances, it may be necessary or desirable to provide for each balancing zone (44,46) to comprise a plurality of balancing zone stages (56,58,60,62,64,66) so that the fluid injection pressure can effectively be reduced in stages from the injection zone interfaces (48,50) across a plurality of zone stage interfaces (68,70) so that the pressure on the two sides of any particular zone stage interface (68,70) is preferably substantially balanced or almost substantially balanced. This gradual "step-down" of pressure will facilitate the use of relatively low pressure seals as zone interface elements (40) for all zone interfaces (48,50,68,70).

It should be noted that substantial balancing of pressures is most important at the injection zone interfaces (48,50) and is less important at the balancing zone stage interfaces (68,70). The reason for this is that substantial segregation of balancing fluids is not as important as is segregation of the injection fluid from the balancing fluids.

As a result, in the preferred embodiment of the apparatus (20) there are three zone stages (56,58,60) for the proximal balancing zone (44) and three zone stages (62,64,66) for the distal balancing zone (46). More or fewer zone stages may of course be provided in the apparatus (20). By providing for separate fluid delivery conduits (86) for each zone stage (56,58,60,62,64,66) the step-down of pressure can be achieved by delivering balancing fluid to the different zone stages (56,58,60,62,64,66) at different pressures. The balancing fluid or fluids may be delivered via a single fluid source using pressure regulators for each zone or may be delivered via separate fluid sources.

In the use of the apparatus (20) to perform the method of the invention, the apparatus (20) is first connected with an apparatus conveying mechanism, which in the preferred embodiment is comprised of a coiled tubing string (32). The apparatus (20) is then lowered into the borehole (22) with the zone interface elements (40) in the retracted position. Borehole parameters may be sensed with the sensing apparatus (98) as the apparatus is moved through the borehole (22).

Once the apparatus (20) has been conveyed to the desired injection location in the borehole (22), the zone interface elements (40) may be moved to the extended position with the zone interface element actuator (72) so that the linkage collars (80) and the manifolds (88) are aligned. Injection of the injection fluid into the primary injection zone (42) and injection of balancing fluids into the balancing zones (44,46) may then commence simultaneously, during which the injection pressures in the various zones (42,44,46) and zone stages (56,58,60,62,64,66) are preferably controlled in order to ensure that the pressure differential across any zone interface (48,50,68,70) is within the sealing capacity of the zone interface elements (40).

The apparatus (20) may continue to be conveyed through the borehole (22) while injection is ongoing since the zone interface elements (40) do not unduly inhibit passage of the apparatus (20) through the borehole (22). Sensing of borehole parameters with the sensing apparatus (98) may also continue while injection of fluids and movement of the apparatus (20) through the borehole (22) is ongoing.

Once injection of fluids is completed, the zone interface elements (40) may be retracted with the zone interface element actuator (72) and the apparatus (20) may be withdrawn from the borehole (22).

The invention is particularly suited for applications where a small section of borehole (22) must be selectively treated or where a large section or sections of borehole (22) must be treated and it is otherwise difficult to deliver adequate amounts and concentrations of fluids to the desired section or sections of the the borehole (22).

The embodiments of the invention in which an exclusive property or privilege is claimed are defined as follows:

1. An apparatus for injecting an injection fluid into a borehole, the apparatus comprising:

(a) a body adapted for passage through the borehole such that an annular space is provided between an outer surface of the body and an inner surface of the borehole;

(b) at least four radially extendable and retractable zone interface elements spaced longitudinally along the body, for filling the annular space between the outer surface of the body and the inner surface of the borehole when extended to define at least three zones along the body;

(c) a zone interface element actuator associated with the zone interface elements for selectively extending and retracting the zone interface elements; and (d) a fluid delivery system associated with each zone for delivering a fluid to each zone from within the body;

wherein the zone interface elements when extended permit the passage of the apparatus through the borehole while inhibiting the fluids from passing between zones.

2. The apparatus as claimed in claim 1 wherein the fluid delivery system is comprised of a plurality of fluid delivery conduits, wherein at least one fluid delivery conduit communicates with each zone.

3. The apparatus as claimed in claim 2 wherein the fluid delivery conduits are carried within the body.

4. The apparatus as claimed in claim 1 wherein the zone interface element actuator is comprised of a reciprocating actuator piston contained within an actuator chamber.

5. The apparatus as claimed in claim 4 wherein the actuator chamber is carried on the body.

6. The apparatus as claimed in claim 4 wherein the zone interface element actuator is further comprised of a linkage assembly linking the actuator piston and the zone interface elements such that reciprocation of the actuator piston will alternately extend and retract the zone interface elements.

7. The apparatus as claimed in claim 6 wherein the linkage assembly is comprised of a plurality of linkage collars between adjacent zone interface elements for connecting adjacent zone interface elements.

8. The apparatus as claimed in claim 7 wherein the zone interface elements and the linkage collars are slidably carried on the outer surface of the body.

9. The apparatus as claimed in claim 8 wherein the fluid delivery system is comprised of a plurality of fluid delivery conduits carried within the body, wherein at least one fluid delivery conduit communicates with each zone, and wherein the fluid delivery conduits communicate with the zones via apertures defined by the linkage collars.

10. The apparatus as claimed in claim 8 wherein each zone interface element is comprised of a bellows-shaped resilient member which is extended when compressed and which is retracted when expanded.

11. The apparatus as claimed in claim 8 wherein the zone interface element actuator is further comprised of at least one actuator conduit for delivering an actuating fluid to the actuator chamber.

12. The apparatus as claimed in claim 11 wherein the actuator piston is a double acting piston.

13. The apparatus as claimed in claim 12 wherein the actuator piston divides the actuator chamber into two sides and wherein the zone interface element actuator is comprised of a plurality of actuator conduits for delivering the actuating fluid to both sides of the actuator chamber.

14. The apparatus as claimed in claim 13 wherein the actuator conduits are carried within the body.

15. The apparatus as claimed in claim 8 further comprising a connector for connecting the apparatus with an apparatus conveying mechanism operated from outside the borehole.

* * * * *